US011441766B2

(12) United States Patent
Yu

(10) Patent No.: US 11,441,766 B2
(45) Date of Patent: Sep. 13, 2022

(54) TREE POLE WITH BUILT-IN INDIVIDUALLY CONTROLLED LED LIGHTING SYSTEM

(71) Applicant: Ledup Manufacturing Group Limited, Irwindale, CA (US)

(72) Inventor: Jing Jing Yu, Irwindale, CA (US)

(73) Assignee: Ledup Manufacturing Group Limited, Irwindale, CA (US)

( * ) Notice: Subject to any disclaimer, the term of this patent is extended or adjusted under 35 U.S.C. 154(b) by 0 days.

(21) Appl. No.: 17/368,521

(22) Filed: Jul. 6, 2021

(65) Prior Publication Data

US 2022/0082243 A1 Mar. 17, 2022

Related U.S. Application Data

(60) Provisional application No. 63/077,879, filed on Sep. 14, 2020.

(51) Int. Cl.

| | |
|---|---|
| ***F21V 23/06*** | (2006.01) |
| ***F21S 6/00*** | (2006.01) |
| ***F21V 23/00*** | (2015.01) |
| ***F21S 4/22*** | (2016.01) |
| ***F21V 23/04*** | (2006.01) |
| ***F21Y 115/10*** | (2016.01) |
| ***F21W 121/04*** | (2006.01) |

(52) U.S. Cl.

CPC ..... *F21V 23/06* (2013.01); *F21S 4/22* (2016.01); *F21S 6/004* (2013.01); *F21V 23/006* (2013.01); *F21V 23/0435* (2013.01); *F21W 2121/04* (2013.01); *F21Y 2115/10* (2016.08)

(58) Field of Classification Search

CPC .... F21V 23/06; F21V 23/006; F21V 23/0435; F21V 33/0028; F21S 4/22; F21S 6/004; F21S 4/10; F21W 2121/04; F21Y 2115/10; A47G 33/06

See application file for complete search history.

(56) References Cited

U.S. PATENT DOCUMENTS

| | | | | |
|---|---|---|---|---|
| 9,593,831 | B2 | 3/2017 | Yu | |
| 9,861,147 | B1 * | 1/2018 | Chen | F21V 23/06 |
| 9,991,654 | B1 * | 6/2018 | DePhillips | F21S 4/10 |
| 10,010,208 | B2 * | 7/2018 | Chen | F21S 4/10 |
| 10,542,602 | B2 | 1/2020 | Yu | |
| 10,683,975 | B2 * | 6/2020 | Zinsky | F21S 9/032 |

* cited by examiner

*Primary Examiner* — Peggy A Neils

(74) *Attorney, Agent, or Firm* — William W. Cochran; Cochran Freund & Young, LLC

(57) ABSTRACT

Disclosed is a unique trunk of a tree pole for a pre-lit Christmas tree. An inexpensive and easily fabricated circuit board is placed inside the tree trunk that has light sockets mounted directly to the printed circuit board. In addition, controllers and IoT devices can also be mounted on the printed circuit board. Pre-lit Christmas trees can be monitored and operated from any Internet location and each of the light strings on each of the branches can be separately controlled.

24 Claims, 11 Drawing Sheets

TREE POLE WITH BUILT-IN INDIVIDUALLY CONTROLLED LED LIGHTING SYSTEM

CROSS-REFERENCE TO RELATED APPLICATION

This Non-Provisional patent application claims the benefit of the U.S. Provisional Patent Application No. 63/077,879, entitled "Tree Pole with Built-In Individually Controlled LED Lighting System" which was filed with the U.S. Patent & Trademark Office on Sep. 14, 2020, which is specifically incorporated herein by reference for all that it discloses and teaches.

BACKGROUND

Pre-lit artificial Christmas trees have become popular as replacements for live trees. More and more people are adopting artificial pre-lit Christmas trees that utilize LEDs because LEDs can be used year after year, saving money, and have a very long lifespan. The ease of assembly and disassembly outweighs the burdens of the tasks and costs of obtaining and disposing of live trees every year.

SUMMARY

The present invention may therefore comprise a method of making a tree pole assembly for a pre-lit Christmas tree comprising: providing a hollow trunk having a length, an outer surface and an inner surface; mounting a plurality of light sockets on a printed circuit board; connecting the light sockets to conductive leads on the printed circuit board to form a circuit bus; mounting a controller on the printed circuit board that is connected to the conductive leads; mounting the printed circuit board to the interior surface of the hollow trunk so that the light sockets extend through the hollow trunk.

The present invention may further comprise a tree pole assembly for a pre-lit Christmas tree comprising: a hollow trunk; a printed circuit board disposed in the hollow trunk; a plurality of light sockets mounted on the printed circuit board that extend from the printed circuit board through holes in the hollow trunk and extend from the exterior surface of the hollow trunk allowing the LED light strings to be connected to the plurality of light sockets; a controller mounted on the printed circuit board; a printed circuit board bus that connects the controller to the plurality of light sockets so that the controller individually controls the LED light strings connected to the plurality of light sockets.

The present invention may further comprise a method of making a tree pole assembly for a pre-lit Christmas tree comprising: providing a hollow trunk having a length, an outside surface and an inside surface; connecting a plurality of light sockets to a circuit bus comprising a plurality of wires; connecting a controller to the circuit bus; placing the light sockets, the controller and the circuit bus inside the hollow trunk; attaching the light sockets to the hollow trunk by securing the light sockets to the outside surface of the hollow trunk so that the light sockets abut against the inside surface of the hollow trunk and protrude through openings in the hollow trunk.

The present invention may further comprise a tree pole assembly for a pre-lit Christmas tree comprising: a hollow trunk having a length, an outside surface and an inside surface; LED light strings disposed on or in artificial tree branches; a circuit bus comprising a plurality of printed circuit board leads on a printed circuit board that is disposed inside the hollow trunk; a plurality of light sockets, disposed in the hollow trunk and mounted on the printed circuit board, the plurality of light sockets extending through openings in the hollow trunk so that the light strings can connect to the light sockets; a controller connected to the circuit bus and disposed in the hollow trunk, the controller individually controlling the LED light strings.

The present invention may further comprise a tree pole assembly for a pre-lit Christmas tree comprising: a printed circuit board disposed inside of a hollow trunk of the tree pole along a length of the tree pole, having printed circuit board leads; a controller mounted on the printed circuit board and connected to the printed circuit board leads; an Internet of Things communication system mounted on the printed circuit board and connected to the printed circuit board leads to control the controller.

The present invention may further comprise a tree pole assembly for a pre-lit Christmas tree comprising: a hollow trunk; a frame mounted inside the hollow trunk and secured to an inner surface of the hollow trunk; a printed circuit board mounted on the frame.

The present invention may further comprise a tree pole assembly for a pre-lit Christmas tree comprising: a printed circuit board mounted in a hollow trunk of the tree pole assembly; light sockets mounted on the printed circuit board that extend through the hollow trunk.

The present invention may further comprise a tree pole assembly for a pre-lit Christmas tree comprising: a frame having slots that form rails of the frame disposed inside of said tree pole assembly; a printed circuit board mounted in the slots of the frame.

The present invention may further comprise a tree pole assembly for a pre-lit Christmas tree comprising: a hollow trunk of the tree pole assembly-, a printed circuit board mounted in the hollow trunk of the tree pole assembly; light sockets having a light socket base, the light socket base having rounded edges that match a curvature of an inside surface of the hollow trunk, the light sockets wired to the printed circuit board; a threaded shaft on the light sockets that extends through the hollow trunk; a nut threaded onto the threaded shaft that causes the rounded edges of the light socket base to be compressed against the inside surface of the hollow trunk.

DETAILED DESCRIPTION OF THE EMBODIMENTS

Figure 1:
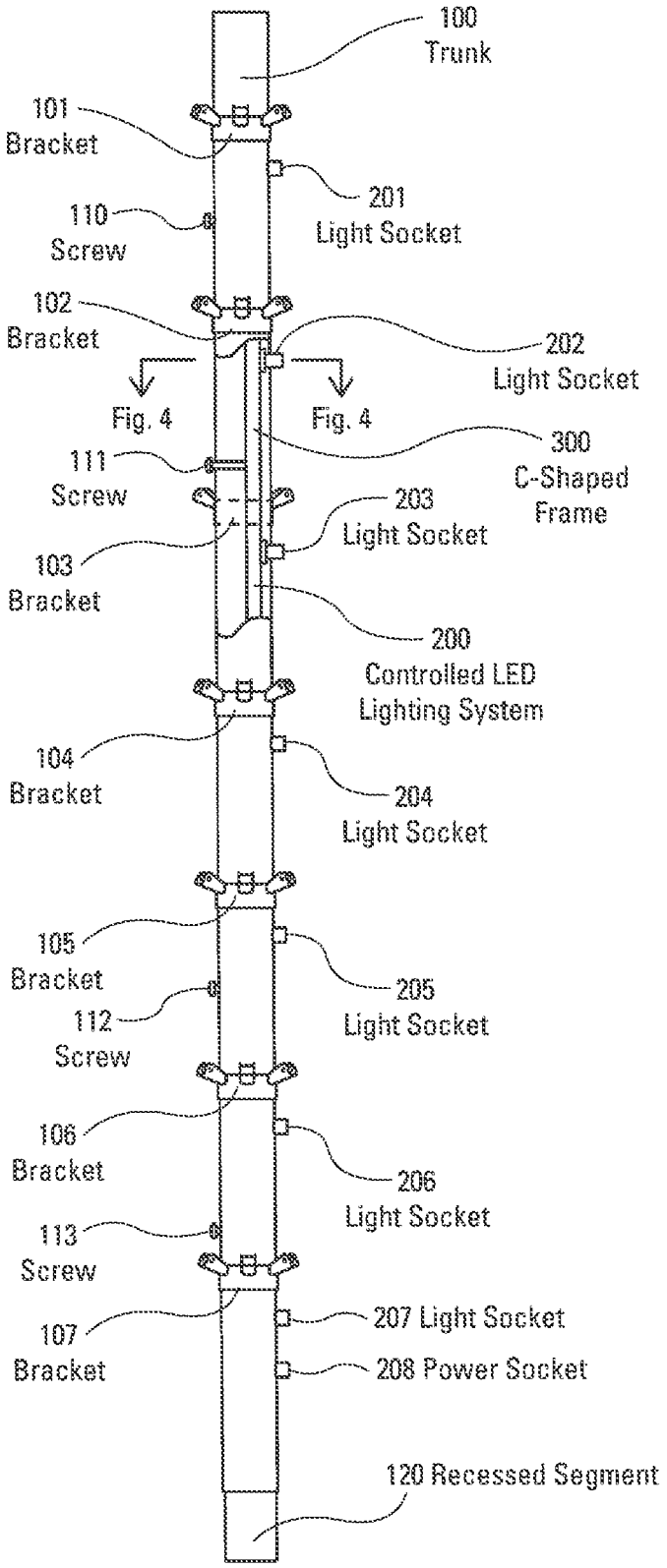
FIG. 1 illustrates an embodiment of a tree pole with a built-in individually controlled lighting system.

FIGS. 1-5 illustrate an embodiment of a controlled LED lighting system 200 that is disposed in a trunk 100 of a tree pole of a pre-lit Christmas tree. As illustrated in FIG. 1, there are a plurality of brackets 101-107 that are attached to the outside surface of the trunk 100. Brackets 101-107 are designed to hold branches of a pre-lit Christmas tree. The brackets are spaced out along the trunk 100, which is usually by even distances. The brackets 101-107 are located adjacent to light sockets 201-207. In this manner, light strings on the branches can be plugged directly into the light sockets 201-207. A power socket 208 is also located near the bottom portion of the trunk 100. A power cord is plugged into the power socket 208 to provide power to a controlled LED lighting system 200 located on an interior portion of the trunk 100. The controlled LED lighting system 200 is mounted on a C-shaped frame 300. The C-shaped frame 300 is held in place on the interior portion of the trunk 100 by screws 110-113. A recessed segment 120 of the trunk 100 allows the trunk 100 to be fitted in a base to hold the trunk 100 in a vertical position as shown in FIG. 1.

Figure 2:
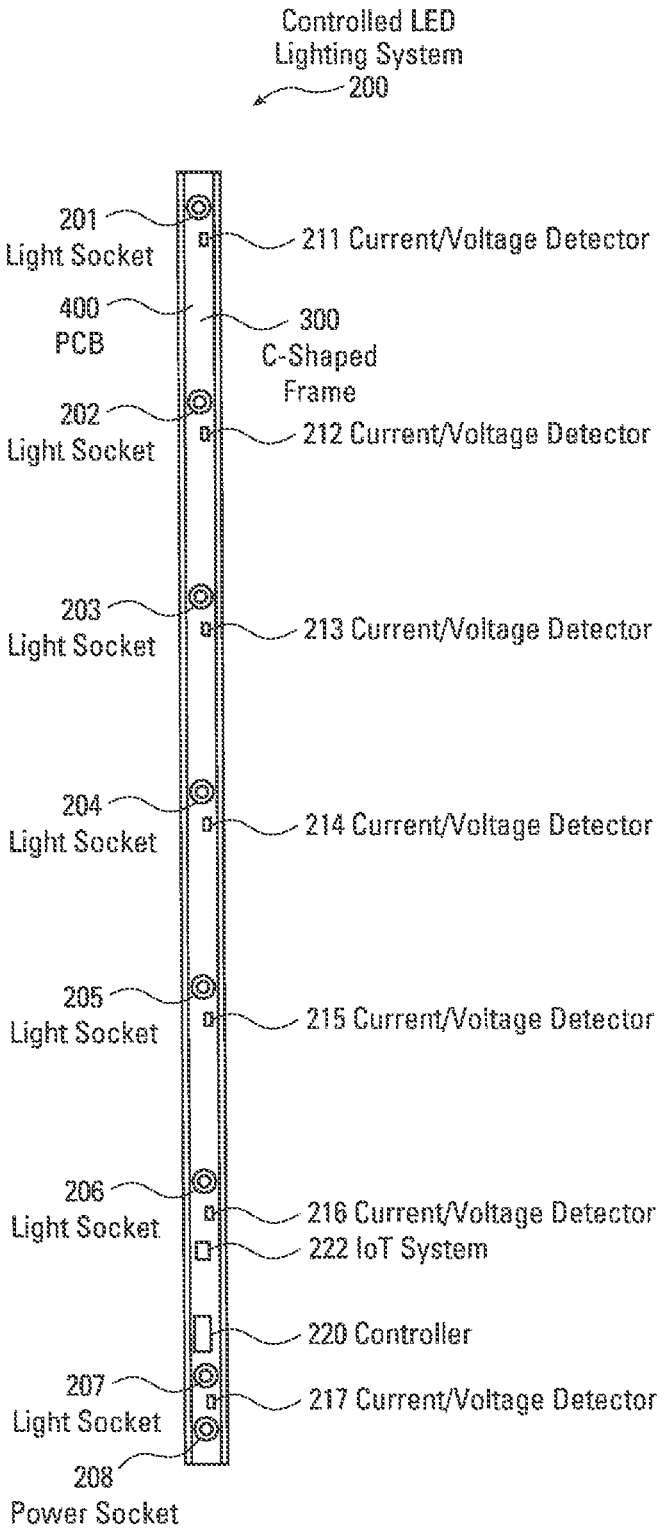
FIG. 2 illustrates an embodiment of a lighting system that is disposed inside the trunk of a tree pole.

FIG. 2 is a front view of an embodiment of a controlled LED lighting system 200. The controlled LED lighting system 200 utilizes a printed circuit board assembly (PCB) 400 that is mounted in a C-shaped frame 300. A plurality of light sockets 201-207 are mounted on the printed circuit board assembly 400. In addition, a plurality of current/voltage detectors 211-217 are also mounted on the printed circuit board assembly 400. The current/voltage detectors 211-217 detect and monitor the voltage and current at each of the light sockets 201-207. Controller 220 controls the function of the light strings that are connected to the light sockets 201-207. Each of the light strings that are connected to the light sockets 201-207 can be individually controlled by the controller, such as disclosed in U.S. Pat. No. 10,542,602, issued Jan. 21, 2020 to Yu, entitled "Individually Accessible LED Light System," and U.S. Pat. No. 9,593,831, issued Mar. 14, 2017 to Yu, entitled "Artificial LED Lighted Christmas Tree," which are specifically incorporated herein by reference for all that they disclose and teach. The controller, as disclosed in the above-referenced patents, can control intensity, fading, blinking, colors and other functions of a light string. An Internet of Things (IoT) system 222 is also mounted on the printed circuit board assembly 400. The IoT device 222 is a communication system that provides information over the Internet regarding the operation of the controlled LED light system 200. The IoT device 222 can be accessed by service personnel to determine proper operation of the controlled LED lighting system 200. In addition, the user can access the IoT device 222 to control the functions of each of the light strings via controller 220. IoT device 222 is a secure device so that only certain individuals can access the IoT device 222 and control the LED lighting system 200.

Figure 3:
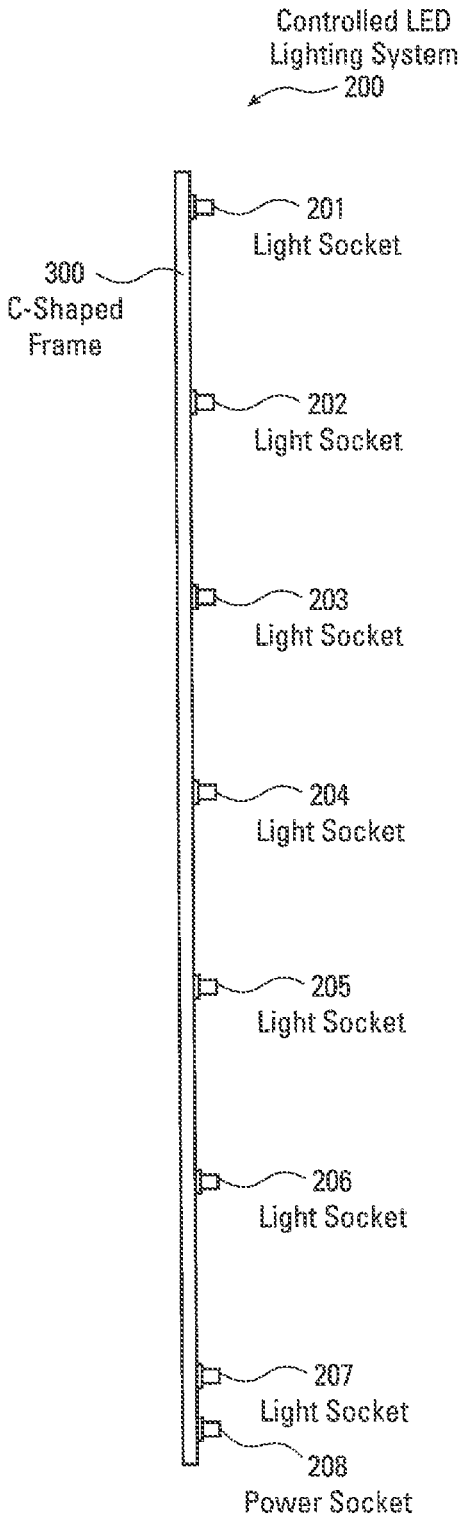
FIG. 3 is a side view of the lighting system of FIG. 2.

FIG. 3 is a side view of controlled LED lighting system 200. As illustrated in FIG. 3, the C-shaped frame 300 holds the printed circuit board assembly 400 (FIG. 2) so that the light sockets 201-207 protrude from the C-shaped frame 300, as illustrated in FIG. 3.

Figure 4:
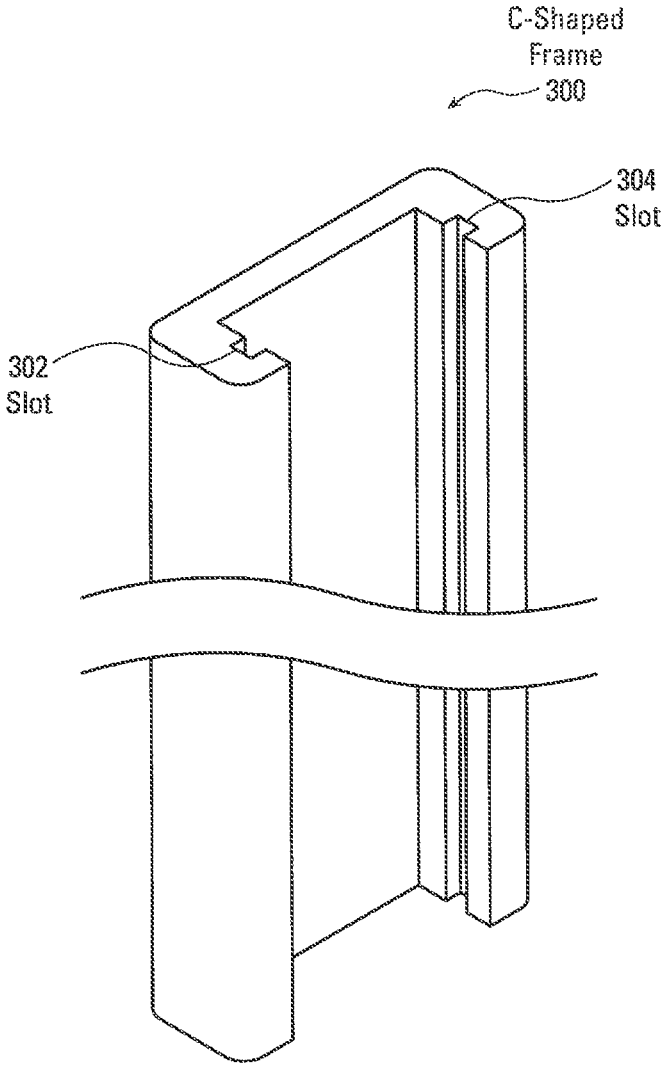
FIG. 4 is perspective view of a C-shaped frame which is used for the lighting system.

FIG. 4 is a perspective view of an embodiment of a C-shaped frame 300. As illustrated in FIG. 4, the C-shaped frame 300 has slots 302, 304 that receive the printed circuit board assembly 400, illustrated in FIG. 2 and FIG. 6. C-shaped frame 300 can be a metal frame, plastic frame or other type of frame that has a rigid structure.

Figure 5:
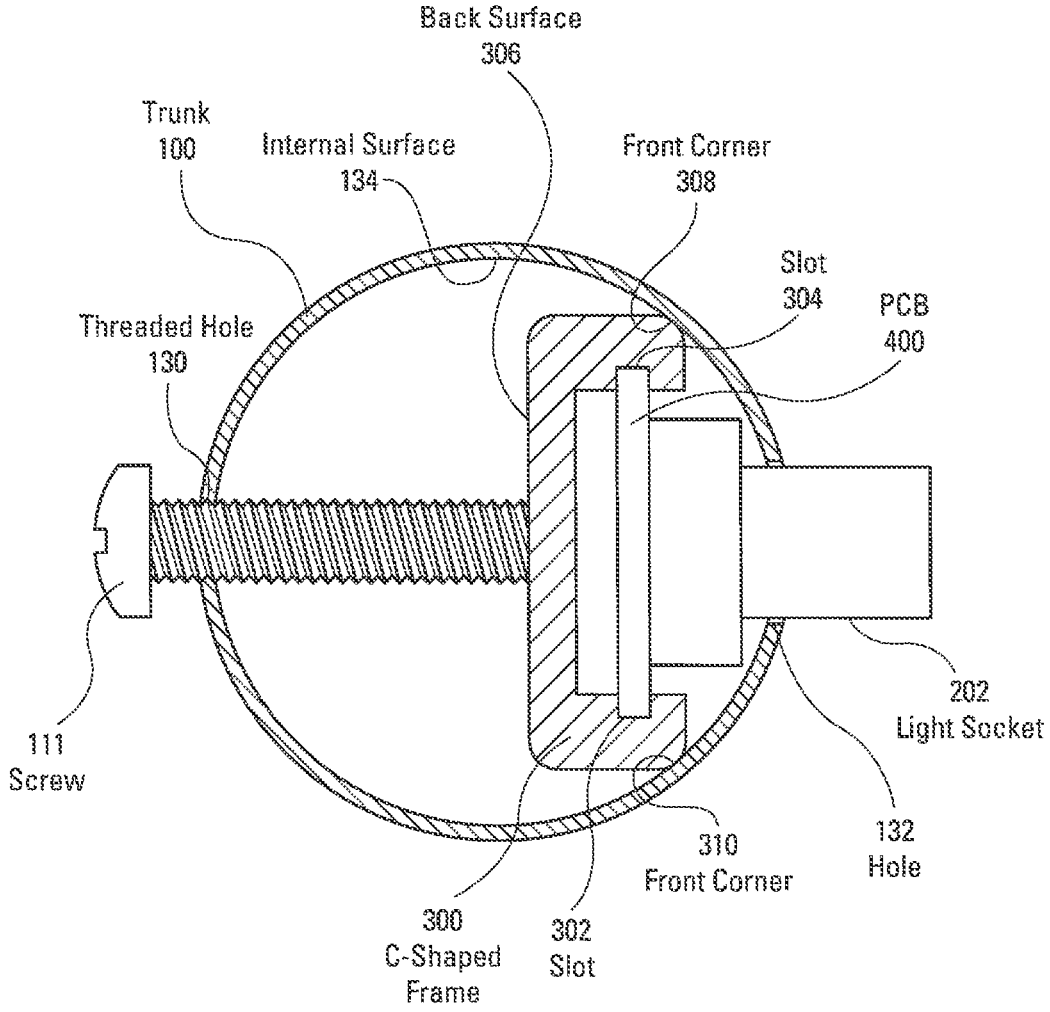
FIG. 5 is an exploded sectional view of the lighting system disposed in a trunk of a tree pole.

FIG. 5 is a cross-sectional view from the section illustrated in FIG. 1. As shown in FIG. 5, the trunk 100 is shown in cross-section. Screw 111 is threaded through a threaded hole 130 in trunk 100 to the interior portion of the trunk 100. The back surface 306 of the C-shaped frame 300 is engaged by screw 111, which stabilizes the C-shaped frame 300 and locks the C-shaped frame 300 in position on the interior portion of the trunk 100. Front corners 308, 310 are shaped to engage the internal surface 134 of the trunk 100. The printed circuit board assembly 400 is secured in slots 302, 304. The sizing of the slots 302, 304 and the thickness of the printed circuit board assembly 400 creates sufficient friction to hold the printed circuit board assembly 400 in a stable position in slots 302, 304 of trunk 100. Light socket 202 protrudes through a hole 132 in the trunk 100. In this fashion, the light socket 202 is accessible on the exterior portion of the trunk 100.

Figure 6:
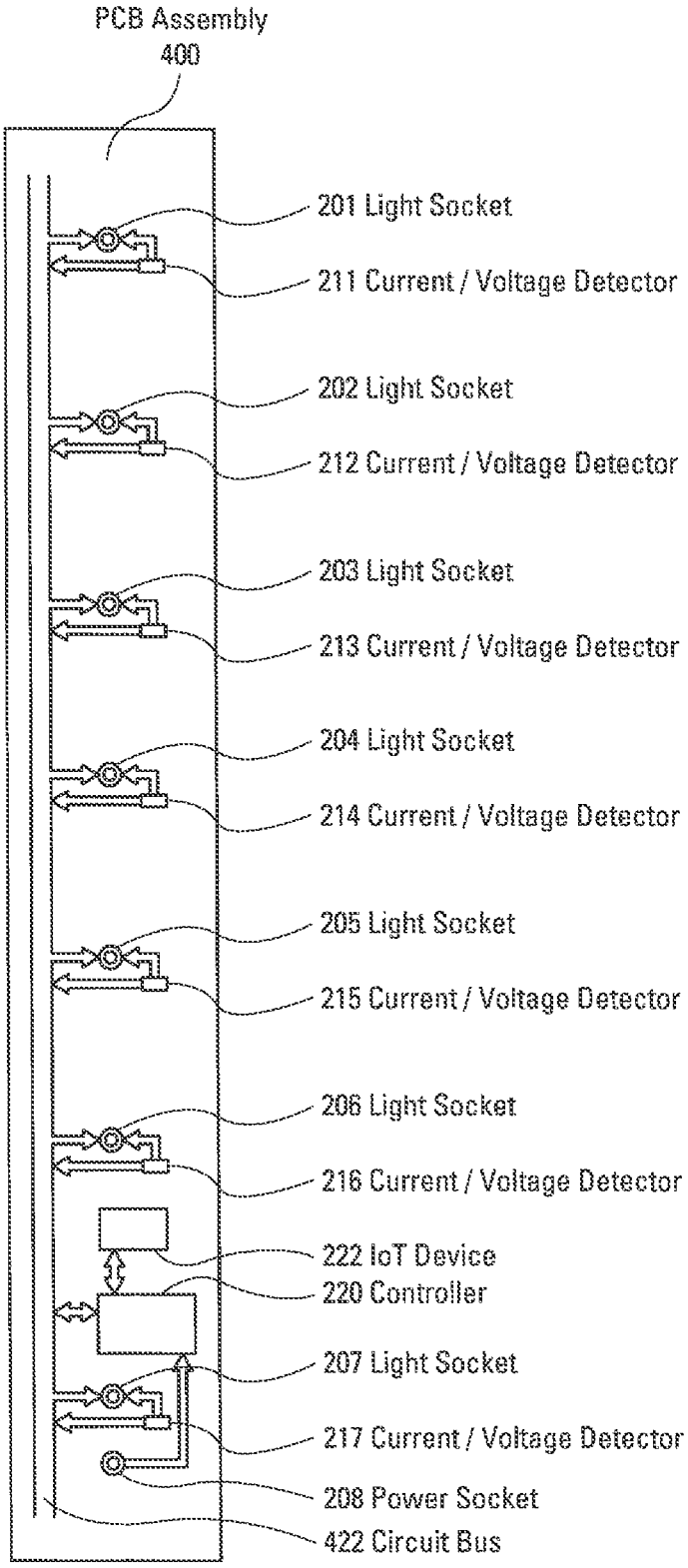
FIG. 6 is a schematic illustration of the printed circuit board assembly for use with the lighting system of FIGS. 1-5.

FIG. 6 is a front view of an embodiment of the printed circuit board assembly 400. The printed circuit board assembly 400 includes a circuit bus 422 for transmitting signals to and from the various components mounted on the printed circuit board assembly 400. A plurality of light sockets 201-207 are mounted on the printed circuit board assembly 400 and connected via PCB leads on the printed circuit board assembly 400, as illustrated in FIG. 6. In addition, a plurality of current and voltage detectors 211-217 are also mounted on the printed circuit board assembly 400 and connected by printed circuit board leads to the light sockets 201-207 and to the circuit bus 422. The current and voltage detectors 211-217 detect and monitor the current and voltages at the light sockets 201-207 and provide that information over the circuit bus 422 to the controller 220 and IoT device 222. Controller 220, as set forth above, controls the operation of each of the light strings and in some implementations, each of the lights that are connected to light sockets 201-207. IoT device 222 transmits data over the Internet regarding the LED lighting system 200 (FIG. 2). IoT device 222 connects controller 220 to the Internet so that controller 220 can be monitored and controlled over the Internet. IoT device 222 connects the circuit bus 422 to the Internet either wirelessly or through a wired connection. Data regarding the operation of the printed circuit board assembly 400 is transmitted over the Internet to individuals such as support personnel. Users can control the operation of the controller 220 and the light strings over the Internet.

Figure 7:
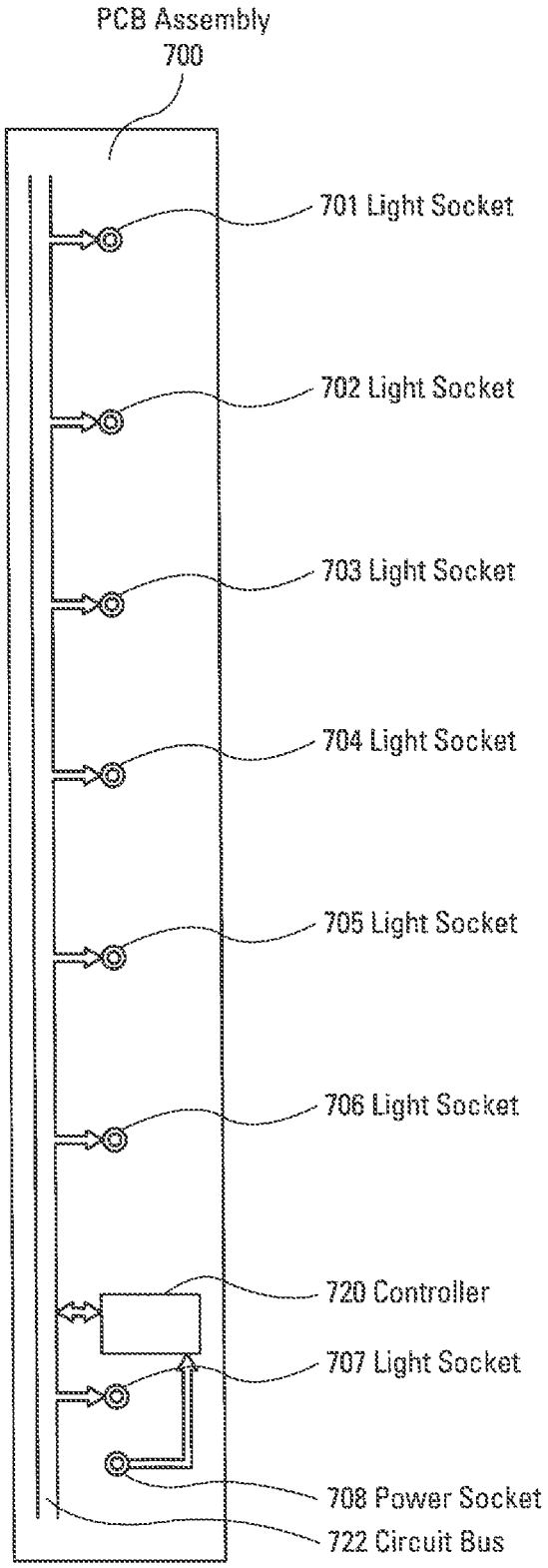
FIG. 7 is an illustration of another embodiment of a printed circuit board assembly.

FIG. 7 is a schematic illustration of another embodiment of a printed circuit board assembly 700. As illustrated in FIG. 7, a series of light sockets 701-707 are mounted on the printed circuit board assembly 700 and are connected to the circuit bus 722 by printed circuit board leads. A power socket 708 provides power to the printed circuit board assembly 700. Controller 720 controls the operation of the light strings connected to the light sockets 701-707. Control signals can be communicated to controller 720 by modulation of the power signal transmitted through power socket 708.

Figure 8:
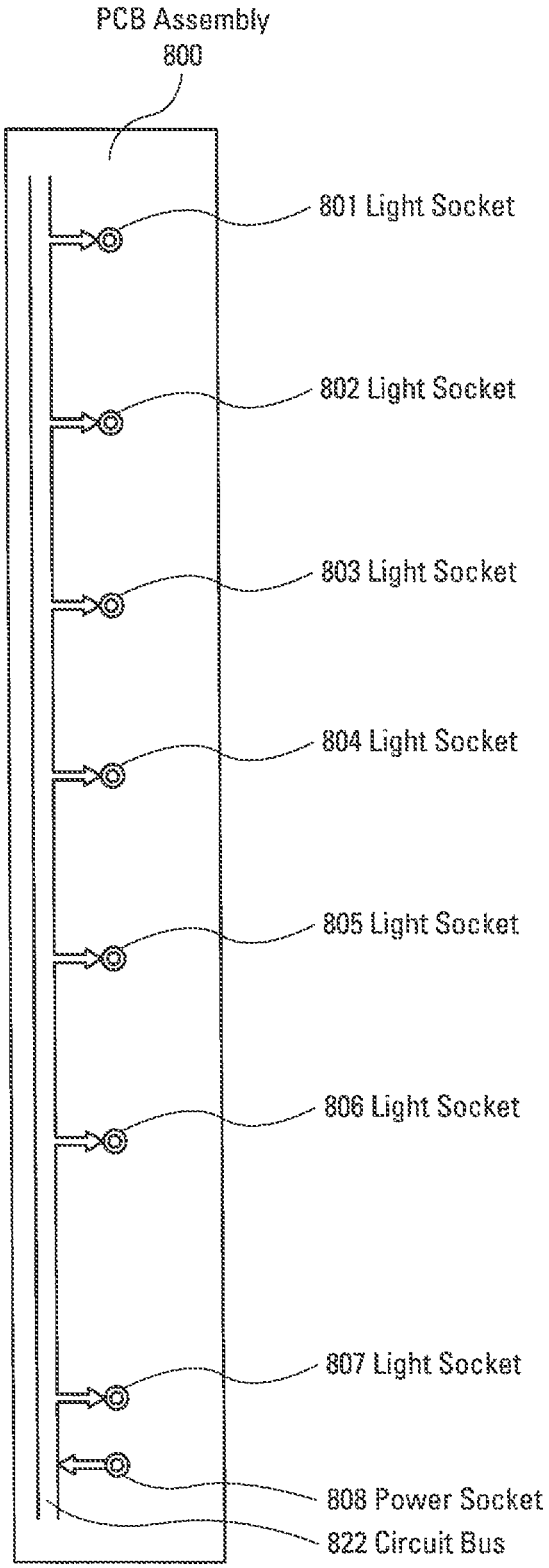
FIG. 8 illustrates another embodiment of a printed circuit board assembly.

FIG. 8 is another embodiment of a printed circuit board assembly 800. Light sockets 801-807 are mounted on the printed circuit board assembly 800 and are connected to the circuit bus 822 via printed circuit board leads. Power socket 808 is also connected to the circuit bus 822.

Figure 9:
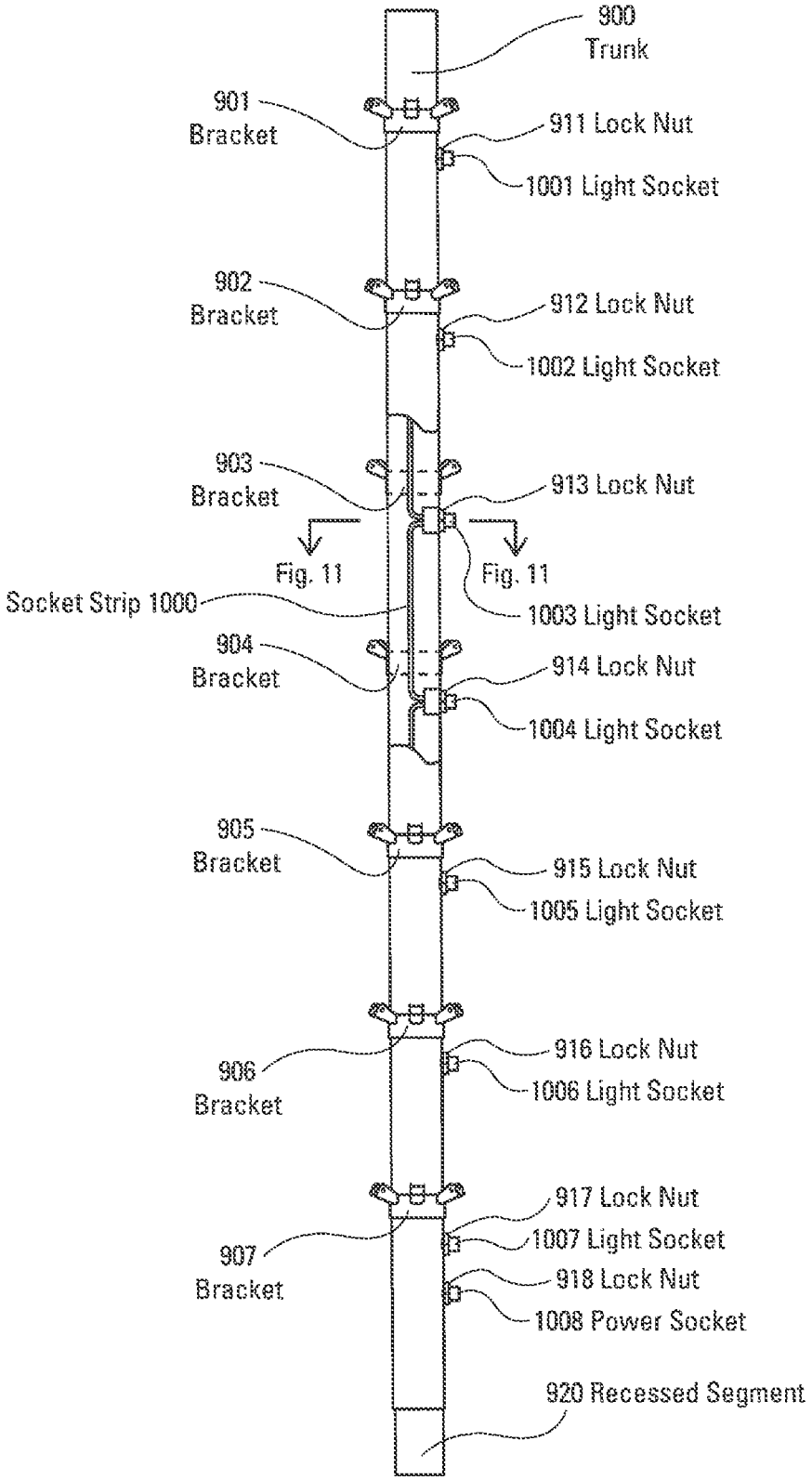
FIG. 9 is another embodiment of a trunk that uses a socket strip.

FIG. 9 is a schematic side cut-away view of a trunk 900, having a series of brackets 901-907 mounted on the exterior surface of the trunk 900. Light sockets 1001-1007 extend from the exterior surface of the trunk 900. Light strings on branches mounted on the brackets 901-907 are powered by the light sockets 1001-1007. Power socket 1008 provides power to the socket strip 1000. A socket strip 1000 comprises a series of wires that connect to the light sockets 1001-1007. A series of lock nuts 911-917 secure the light sockets 1001-1007 to the trunk 900. Locknut 918 secures the power socket 1008 to the trunk 900. Recessed segment 920 allows the trunk 900 to be inserted in a base. The socket strip 1000 provides an alternative manner of connecting the light sockets 1001-1007 to the trunk 900 and communicating information to each of the light sockets 1001-1007.

Figure 10:
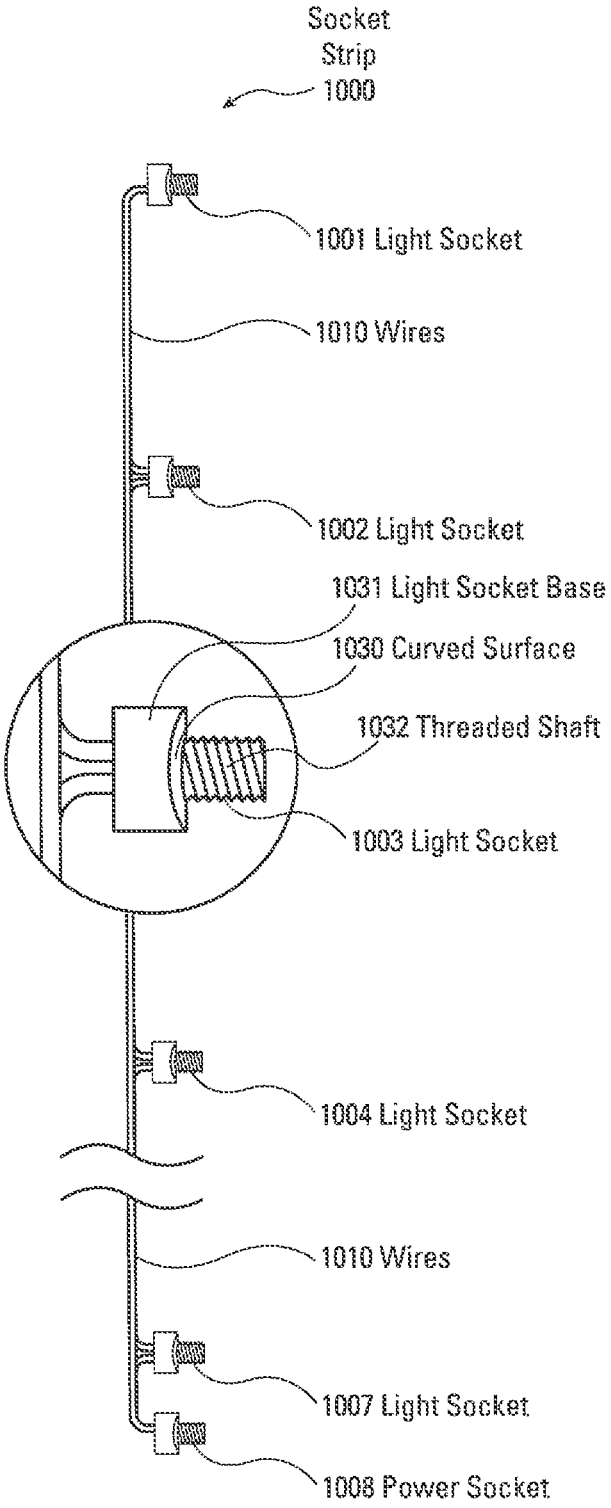
FIG. 10 illustrates an embodiment of a socket strip.

FIG. 10 is a schematic side view of the socket strip 1000. As illustrated in FIG. 10, light sockets 1001-1004 and 1007 are illustrated. Each of the light sockets is connected to wires 1010 that can function as a bus for transmitting information and power to the light sockets. Each of the light sockets 1001-1004 and 1007 has a curved surface 1030 on light socket base 1031 and a threaded shaft 1032 that is connected to light socket base 1031. The curved surface 1030 is curved to match the curved surface of the interior surface of the trunk 900, as disclosed below. Threaded shaft 1032 allows for use of threaded nuts to hold the light sockets 1001-1004 and 1007 to the trunk 900.

Figure 11:
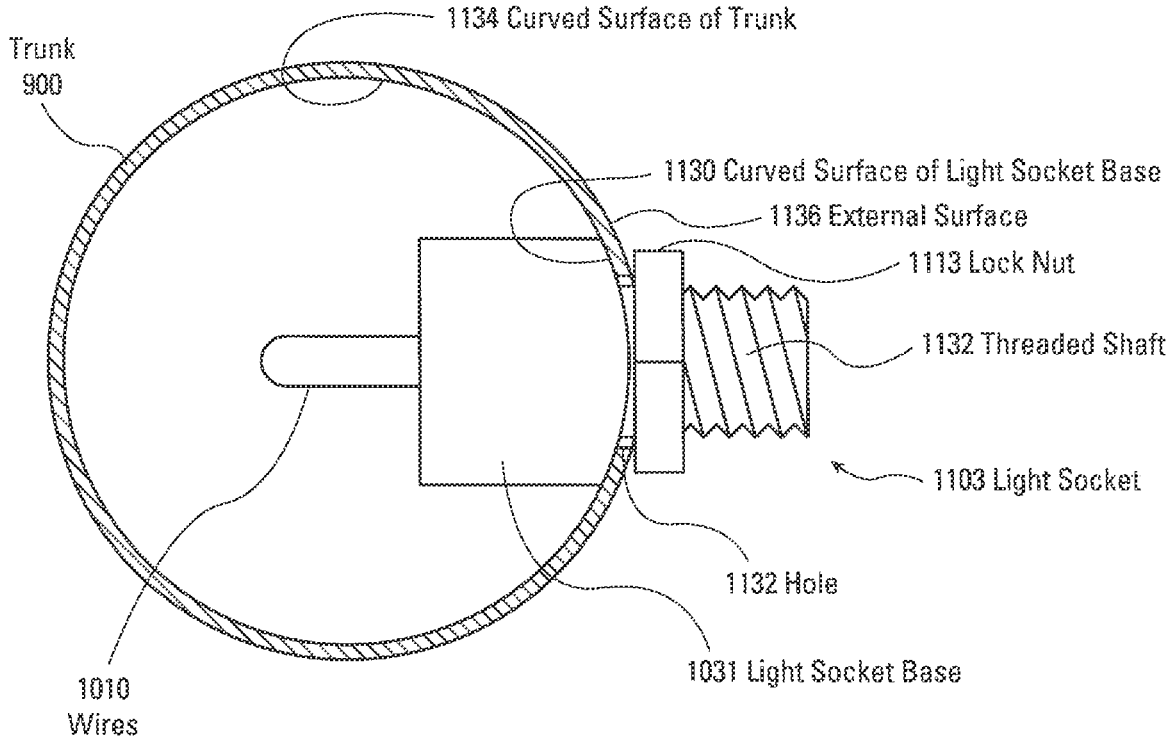
FIG. 11 is an enlarged cross-sectional view of a trunk with a light socket connected to a socket strip disposed in a trunk.

FIG. 11 is a cross-sectional view of the trunk 900, as shown in FIG. 9. As illustrated in FIG. 11, the trunk 900 has an interior curved surface 1134 that matches the curved surface of light socket base 1131. The light socket 1103 is inserted through a hole 1132 and secured to the external surface 1136 by way of lock nut 1113 that is screwed onto the threaded shaft 1132 of light socket 1103. Wires 1010 run between each of the light sockets to provide power and communications that are modulated in the power signal.

The present invention therefore provides a unique tree pole, having brackets that can be easily mounted on the trunk 100 of the tree pole. Brackets allow branches, that are pre-wired with LED lights, to be held on the trunk 900. Light sockets, that protrude from the trunk 100, allow the light strings of each of the branches to receive power and to be separately controlled by a user and monitored by after-sales support staff. In one embodiment, printed circuit boards are mounted on the interior portion of the trunk, which includes controllers, as well as current and voltage monitors. The printed circuit boards can be easily mounted and held in place on the interior portion of the hollow tree trunk in a C-shaped frame. Use of printed circuit boards reduces cost and allows for automation of the construction of the components of the tree pole. IoT devices can also be mounted on the printed circuit board. Internet accessibility to control and monitor the operation of a pre-lit Christmas tree, using the tree pole of the present invention, allows users to control the operation of the tree pole from remote locations over the Internet and simplifies the process of controlling the tree pole. The Internet connections also allow service personnel to quickly and easily monitor the operation of the pole and determine if problems exist from any place in the world. Simple designs are also provided for mounting light sockets in the tree pole trunk, which also simplifies manufacturing of the tree pole trunk. Since most of the components are located on the interior portion of the trunk, a very pleasing appearance of the pre-lit Christmas tree is provided without unsightly and bulky objects located on the tree trunk.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of making a tree pole assembly for a pre-lit Christmas tree comprising:

providing a hollow trunk having a length, an outer surface and an inner surface;

mounting a printed circuit board in a frame disposed on said inner surface at said hollow trunk, said printed circuit board and said frame extending along said length of said hollow trunk;

mounting a plurality of light sockets on said printed circuit board, said plurality of light sockets supported by said printed circuit;

connecting said light sockets to conductive leads on said printed circuit board to form a circuit bus;

mounting a controller on said printed circuit board so that said controller is connected to said conductive leads;

mounting said frame to said inner surface of said hollow trunk so that said light sockets extend through openings in said hollow trunk;

mounting said plurality of light sockets to said hollow trunk to secure said light sockets to said outer surface of said hollow trunk.

2. The method of claim 1 further comprising:

mounting an Internet of Things communication system to said printed circuit board;

connecting said Internet of Things communication system to said conductive leads to allow a user to control operation of said controller and allow for monitoring of operation of said controller over the Internet.

3. The method of claim 2 further comprising:

connecting detectors to said circuit bus that monitor voltage and current at said plurality of light sockets.

4. The method of claim 1 further comprising:

attaching tree limb brackets on said outer surface of said hollow trunk that are spaced along said length of said hollow trunk.

5. The method of claim 1 further comprising:

forcing a light socket base against said inner surface to secure said light sockets to said hollow trunk when mounting said plurality of light sockets to said hollow trunk.

6. A tree pole assembly for a pre-lit Christmas tree comprising:

a hollow trunk;

a frame mounted on an interior portion of said hollow trunk that extends along a length of said hollow trunk;

a printed circuit board disposed in said frame on an interior portion of said hollow trunk;

a plurality of light sockets mounted on said printed circuit board that extend from said printed circuit board through holes in said hollow trunk and extend from an exterior surface of said hollow trunk;

a mounting device that secures said plurality of light sockets in said holes;

a controller mounted on said printed circuit board;

a printed circuit board bus that connects said controller to said plurality of light sockets so that said controller individually controls LED light strings connected to said plurality of light sockets.

7. The tree pole of claim 6 further comprising:

an Internet of Things (Iot) system mounted on said printed circuit board that is connected to said controller by said printed circuit board bus, said IoT system connecting said controller to the Internet so that said controller can be monitored and controlled over the Internet.

8. The tree pole of claim 7 further comprising:

circuit monitors that monitor operation of said tree pole assembly and provide data regarding said operation of said tree pole assembly over said Internet.

9. The tree pole of claim 8 wherein said circuit monitors comprise detectors that monitor voltage and current at said plurality of light sockets.

10. The tree pole of claim 6 further wherein said frame comp rises:

a C-shaped frame that holds said printed circuit board in slots.

11. The tree pole assembly of claim 6 further comprising:

a plurality of tree limb brackets attached to an exterior surface of said hollow trunk.

12. The tree pole of claim 10 further comprising:

a light socket base that engages said interior portion of said hollow trunk to secure said plurality of light sockets to said trunk.

13. A method of making a tree pole assembly for a pre-lit Christmas tree comprising:

providing a hollow trunk having a length, an outside surface and an inside surface;

connecting a plurality of light sockets to a circuit board having a circuit bus comprising connectors disposed on said printed circuit board;

connecting a controller to said circuit bus;

placing said light sockets, said controller and said circuit board inside said hollow trunk;

attaching said light sockets to said hollow trunk by causing said light sockets to abut against said inside surface of said hollow trunk and protrude through openings in said hollow trunk.

14. The method of claim 13 further comprising:

attaching tree limb brackets on said outside surface of said hollow trunk, that are spaced along said length of said hollow trunk.

15. The method of claim 14 further comprising:

connecting an Internet of Things communication system to said circuit bus that allows a user to control operation of said controller over the Internet and allows for monitoring of operation of said controller over the Internet.

16. The method of claim 15 further comprising:

connecting detectors to said circuit bus that monitor operation of said controller.

17. The method of claim 16 wherein said method of attaching said light sockets to said hollow trunk comprises threading nuts on a threaded shaft of said light socket that engage said outside surface of said hollow trunk.

18. The method of claim 16 further comprising:

wirelessly communicating instructions to said Internet of Things communication system to control said controller.

19. A tree pole assembly for a pre-lit Christmas tree comprising:

a hollow trunk having a length, an outside surface and an inside surface;

a circuit bus comprising a plurality of printed circuit board leads on a printed circuit board that is disposed inside said hollow trunk along said length of said hollow trunk;

a plurality of light sockets, disposed in said hollow trunk and mounted on said printed circuit board, said plurality of light sockets extending through openings in said hollow trunk;

a controller connected to said circuit bus and a mounting device that mounts said plurality of light sockets to said hollow trunk, mounted on said printed circuit board.

20. The tree pole of claim 19 further comprising:

an Internet of Things (IoT) communication system mounted on said circuit board and disposed in said hollow trunk, said IoT communication system connected to said circuit bus that connects said controller to the Internet so that operation of LED light strings can be controlled and monitored over the Internet.

21. The tree pole of claim 20 further comprising:

detectors mounted on said circuit board and connected to said circuit bus, that detect voltage and current at said light sockets.

22. The tree pole assembly of claim 19 further comprising:

tree limb brackets, secured to said outside surface of said hollow trunk, that are spaced along said length of said hollow trunk.

23. A tree pole assembly for a pre-lit Christmas tree comprising:

a printed circuit board disposed inside of a hollow trunk of said tree pole along a length of said tree pole, having printed circuit board leads;

a controller mounted on said printed circuit board and connected to said printed circuit board leads;

a frame mounted to said hollow trunk that holds said printed circuit board;

light socket mounted on, and supported by said printed circuit board;

an Internet of Things communication system mounted on said printed circuit board and connected to said printed circuit board leads to control said controller.

24. A tree pole assembly for a pre-lit Christmas tree comprising:

a hollow trunk of said tree pole assembly;

a printed circuit board mounted in said hollow trunk of said tree pole assembly;

light sockets having a light socket base, said light socket base having rounded edges that match a curvature of an inside surface of said hollow trunk, said light sockets mounted on and wired to said printed circuit board;

a threaded shaft on said light sockets that extends through said hollow trunk;

a nut threaded onto said threaded shaft that causes said rounded edges of said light socket base to be compressed against said inside surface of said hollow trunk.

* * * * *